US006728976B1

(12) United States Patent
Halloran et al.

(10) Patent No.: US 6,728,976 B1
(45) Date of Patent: May 4, 2004

(54) TOILET TANK ATTACHMENT BRACKET WITH UNITARY SPRING ARM

(75) Inventors: Daniel N. Halloran, Saukville, WI (US); Andrew H. Matznick, Newton, WI (US); Sudip Mukerji, Cedarburg, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/347,739

(22) Filed: Jan. 20, 2003

(51) Int. Cl.[7] ..... E03D 11/00
(52) U.S. Cl. ..... 4/417
(58) Field of Search ..... 4/417, 418

(56) References Cited

U.S. PATENT DOCUMENTS 1,963,709 A 6/1934 McManama
2,108,625 A * 2/1938 Tilden ..... 4/417
3,448,466 A * 6/1969 Haldopoulos ..... 411/429
4,445,237 A * 5/1984 Paul ..... 4/417
4,757,560 A * 7/1988 Grimstad ..... 4/417
4,850,063 A * 7/1989 Abbate ..... 4/252.1
5,295,273 A 3/1994 Unger et al.

* cited by examiner

*Primary Examiner*—Charles E. Phillips
(74) *Attorney, Agent, or Firm*—Quarles & Brady LLP

(57) ABSTRACT

An attachment system for mounting a flush tank to a toilet bowl includes a bracket disposed between the tank and the bowl. The bracket has a generally planar body defining a central opening receiving a tubular flush extension extending from the tank into an opening in a bowl extension. The bracket is fastened to the tank by a large nut threaded to the tank extension. The bracket is mounted to the bowl at two slots opening at opposite side edges of the bracket by two bolts disposed through openings in the bowl extension. The bracket has a unitary pair of upwardly extending spring arms contacting the bottom wall of the flush tank and a unitary pair of lower spring arms contacting the bowl extension. The spring arms are deflectable between the flush tank and the toilet bowl to accommodate for warping or mold variations between the tank and the bowl.

7 Claims, 3 Drawing Sheets

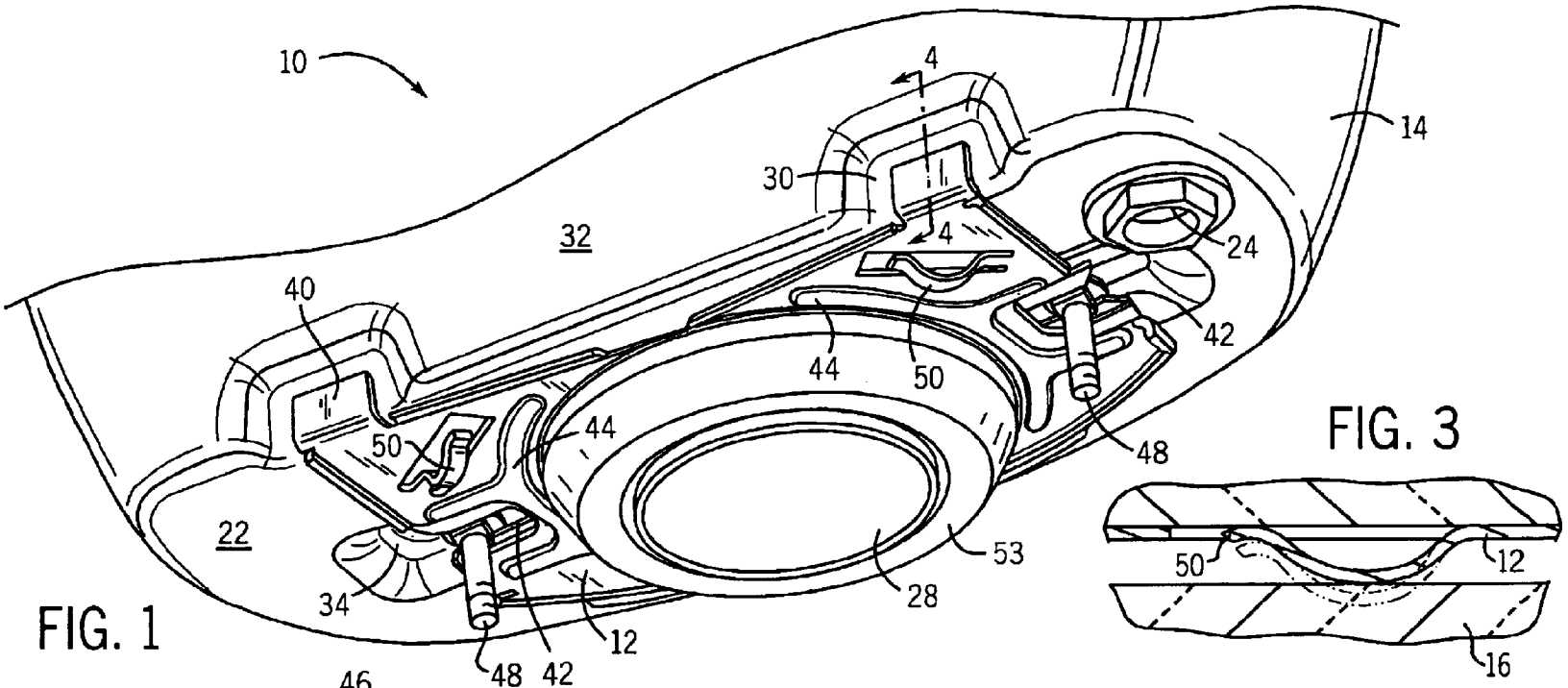
FIG. 1
FIG. 3
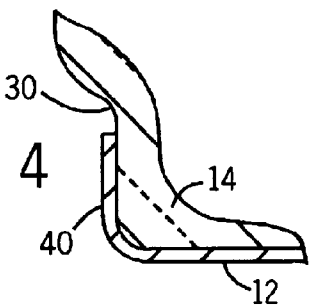
FIG. 4
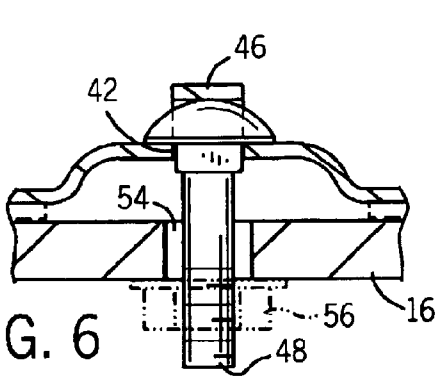
FIG. 6
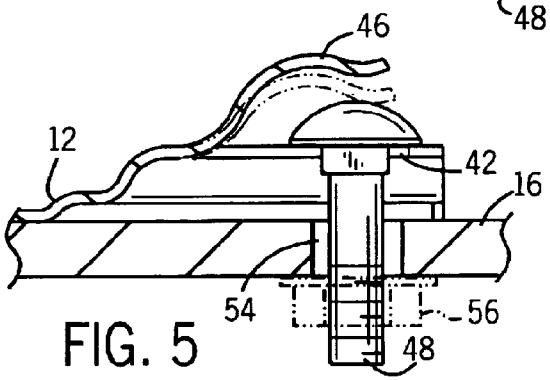
FIG. 5

TOILET TANK ATTACHMENT BRACKET WITH UNITARY SPRING ARM

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to plumbing fixtures, and in particular to a bracket for attaching a toilet tank to a separately formed toilet bowl.

Conventional toilets include a bowl and a flush tank. The bowl and flush tank can be formed in one or two pieces. Two-piece toilets are sometimes less expensive to manufacture, and the weight of the toilet can be split into two for easier handling by the consumer at the time of purchase.

However, two-piece toilets require that the flush tank be assembled to the bowl so that water in the tank can pass into the bowl during a flush cycle. Typically, the bottom wall of the flush tank will have a circular opening in its center through which a tubular section of the flush valve assembly extends. This tubular extension fits into a corresponding opening in a rear extension of the bowl to allow water to flow from the tank into the bowl.

Many conventional two-piece toilets fasten the tank to the bowl using bolts which extend through corresponding openings in the bottom wall of the flush tank and into a rearward extension from the bowl (see e.g. U.S. Pat. No. 5,295,274). This creates potential leak paths through the bottom of the flush tank.

In an alternative approach a bracket can be placed between the tank and the bowl extension with an opening through which extends the tubular extension of the flush valve assembly. The bracket is fixed to the outside of the tank bottom wall and is mounted to the bowl by bolts or integral studs disposed through the mounting openings in the bowl extension (see e.g., U.S. Pat. No. 1,963,709). Since there are no mounting holes in the tank, and the mounting holes in the bowl extension are out of the fluid path between the tank and the bowl, the risk of leakage created by such a connection is less.

However, toilet bowls and flush tanks are most often cast of vitreous china or ceramic material. Such material is somewhat difficult to form perfectly consistently because of warping arising from the molding, curing or firing process.

If such brackets are used with slightly warped extension tops or tank bottoms, the seam between the tank and bowl may appear imperfect to the consumer, and/or may in fact be indicative of a tank that will wobble during use.

In U.S. Pat. No. 1,963,709 there was a suggestion of including a gasket to take up some gaps between the tank and extension. However, this required an additional part, and some additional assembly cost.

Accordingly, a need still exists for improved techniques and assemblies for connecting a toilet tank to a toilet bowl extension.

SUMMARY OF THE INVENTION

In accordance with one aspect, the invention provides an assembly for attaching a flush tank to a toilet bowl. There is a bracket which has a generally planar body having a top face, a bottom face, and a central through opening extending between the top and bottom faces. The body is formed with at least one mounting opening extending between the top and bottom faces. The body is also formed with at least one unitary spring arm extending from a face of the body such that the spring arm is deflectable outward and towards the face from which it extends.

The assembly also has a fastener extendable from an upper face of the body through the mounting opening. Most preferably the mounting opening is a slot that is open laterally along a side of the body, however, it could include an integral stud or various other alternatives.

The concept is that the bracket will surround the flush extension from the tank outside an below the tank, yet above the bowl rearward extension. Fastener bolts can hang down from the top face of the bracket downward into the rearward extension, and then be tightened in the usual manner. The springs correct for any warping in the tank bottom or bowl extension top, thereby providing a smooth, professional looking joint.

In the most preferred forms the bracket has two upper spring arms extendable up above an upper face of the body, and two spring arms extendable down below the bottom face of the body. Thus, warping at all of the portions of the joint, regardless of which part is warped, can be accommodated. In any case, it is highly preferable that the spring arms be integrally formed with the body.

In other preferred forms each spring arm is in the form of an essentially horizontal portion linked to the body, that portion in turn being connected to a generally U-shaped portion that extends outward from and then towards a face of the body. Such spring arms will have a free end.

In another aspect the body can have a pair of alignment tabs extending upward from the top face along a rear edge of the body. These are suitable to fit in corresponding receiving regions along the lower rear portion of the tank such that the bracket is held in place by the flush extension and those receiving regions.

In another form the invention provides a toilet having a bowl and tank. The bowl has a rearward bowl extension having a flush opening leading to the bowl and a pair of mounting holes. The tank has a bottom wall and a tubular flush extension extending beyond the bottom wall into the flush opening of the bowl extension. In accordance with the present invention there is also the above bracket and fastener which are used to connect the bowl to the tank.

It should be appreciated that this connection assembly and these toilets help achieve a smooth, professional looking joint between the bowl and tank. Further, the joint is a secure one which reduces the tendency of the tank to begin wobbling in response to room vibrations or vibrations caused by the plumbing or the flushing of the tank.

The assembly is of few parts, is inexpensive to produce, and is easy to assembly and maintain. These and still other advantages of the invention will be apparent from the detailed description and drawings. What follows is a description of a preferred embodiment of the present invention. To assess the full scope of the invention the claims should be looked to as the preferred embodiment is not intended as the only embodiment within the scope of the invention.

BRIEF DESCRIPTION OF THE DRAWINGS

FIG. 1 is a partial rear perspective view of flush tank of the present invention on which is mounted a fastening assembly of the present invention;

FIG. 3 is a partial cross-sectional view taken along line 3—3 of FIG. 2;

FIG. 4 is a partial cross-sectional view taken along line 4—4 of FIG. 1;

FIG. 5 is a partial cross-sectional view taken along line 5—5 of FIG. 2;

FIG. 6 is a partial cross-sectional view taken along line 6—6 of FIG. 2.

DETAILED DESCRIPTION OF THE PREFERRED EMBODIMENT

Figure 2:
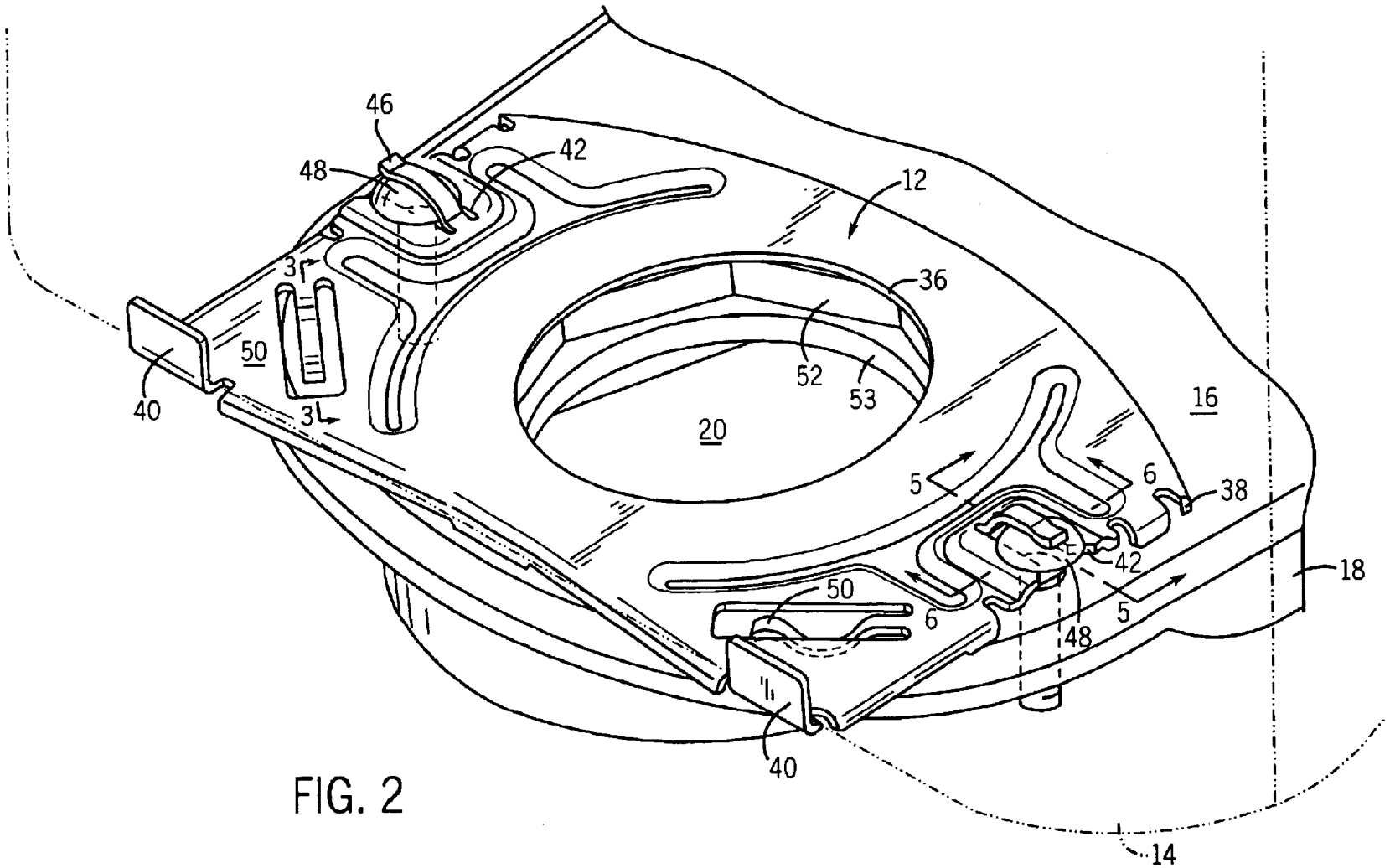
FIG. 2 is a partial perspective view of a flush tank (shown in phantom) which has been mounted on a bowl extension of the present invention using a bracket assembly of the present invention.
Figure 7:
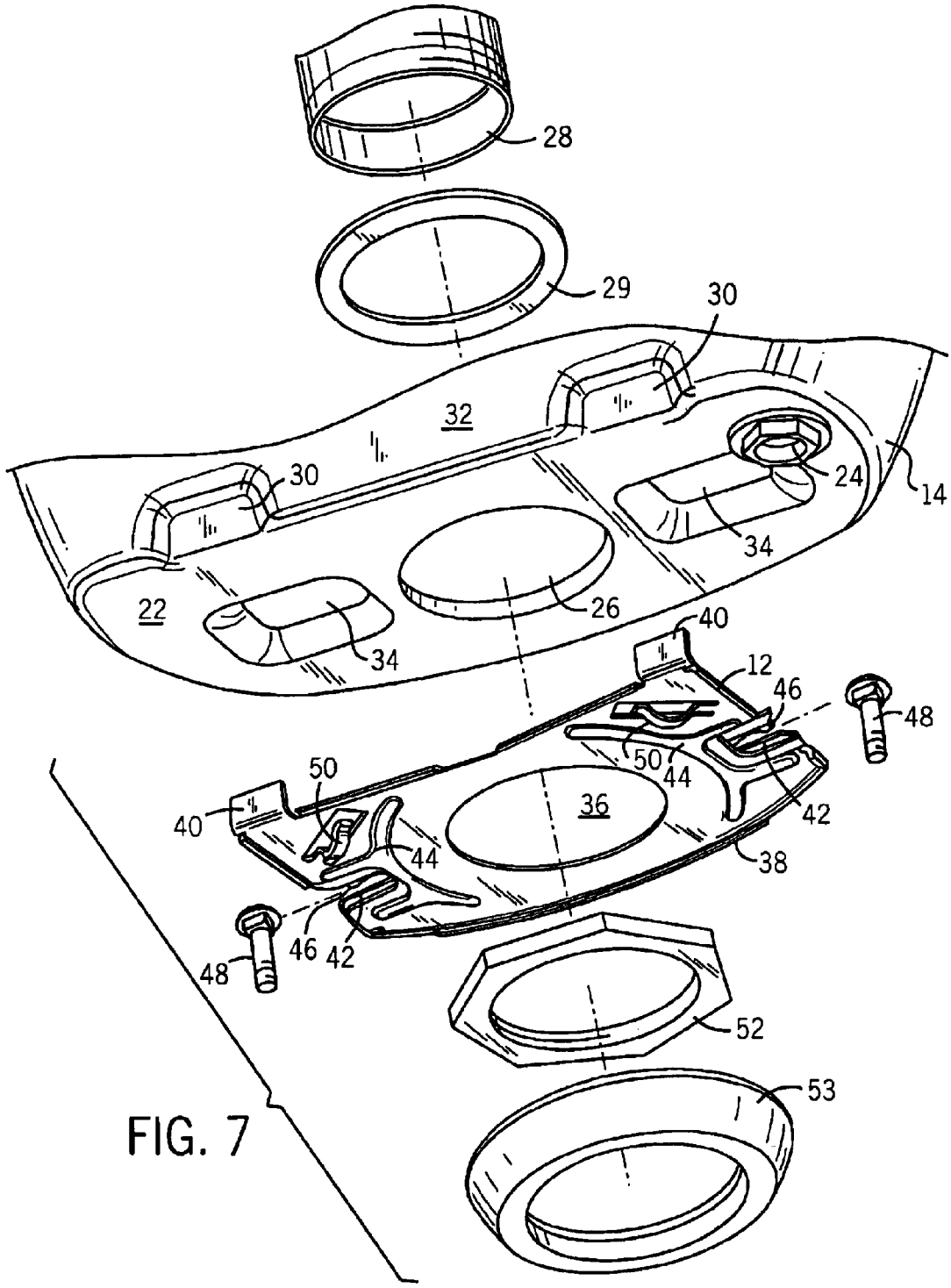
FIG. 7 is a rear, lower, exploded perspective view of various parts of the present invention.

FIGS. 1, 2 and 7 should initially be referred to with respect to a two-piece toilet (generally 10) having a bracket 12 according to the present invention for attaching a tank 14 to a bowl extension 16 of a bowl base 18. The bowl base 18 and its extension 16 are conventional items, made of a vitreous porcelain or china casting. As is standard, the bowl extension 16 is formed with an opening 20, which leads to a bowl (not shown). The tank 14 is generally a standard piece having a bottom wall 22 with a supply inlet opening 24 and a main flush opening 26 through extends an extension 28 of the flush valve (not shown) about which a gasket 29 (see FIG. 7) fits to seal the flush opening 26. The flush tank 14, however, is also formed with two sets of recess features, one set 30 in a back wall 32 of the tank and the other set 34 in the bottom wall 22, for accommodating features of the bracket 12, as described below.

The bracket 12 is disposed between the flush tank 14 and bowl base 18. In addition to joining the two pieces of the toilet 10, the bracket 12 accommodates for warping or other inconsistencies in the cast pieces to provide a solid connection of the flush tank 14 to the bowl base 18.

The bracket 12 is preferably a stamped metal plate having a central opening 36 sized to receive the usual extension 28 from the flush valve. The bracket 12 has a downwardly extending lip 38 along much of its periphery and includes two alignment tabs 40 extending upwardly from a back edge to fit into the recesses 30 in the back wall 32 of the flush tank 14, as shown in FIGS. 1 and 4.

Two slots 42 extend between a pair of legs of two downwardly projecting saddle-shaped stand-offs 44 and open at opposite sides of the bracket 12. Part of the material removed to form the slots 42 is bent upward to form convex upper spring arms 46 with their middles and free ends spaced above each slot 42. The slots 42 are sized to accommodate the shafts of two bolts 48, the heads of which fit in the space between the upper spring arms 46 and the main surface of the bracket 12, as shown in FIGS. 2, 5 and 6. Preferably, the bolts 48 are cap head carriage bolts having squared shaft sections below the caps that engage the edges of the slots 42 to prevent the bolts 48 from rotating.

The recesses 34 in the bottom wall 22 of the flush tank 14 accommodate the upper spring arms 46 and bolt heads when the components are assembled. Two additional spring arms 50 are formed in the interior of the bracket 12 between the slots 42 and the alignment tabs 40. Lower spring arms 50 form downwardly extending convex surfaces with their middles spaced from the plane of the bracket 12.

As shown by the hidden line representations in FIGS. 2 and 5, the upper 46 and lower 50 spring arms are deflectable and somewhat resilient. This allows the bracket 12 to accommodate variation in the vertical spacing between the bottom of the flush tank 14 and the bowl extension 18. Such variation can be quite common due to warping of the cast pieces during the curing process or simply from imperfections and variations inherent in casting vitreous porcelain or china. Without the flexibility of provided by the spring arms, the flush tank 14 may not sit securely on the bowl extension 16, but instead may teeter or rock if disturbed. While the spring arms are deflectable, they are rather strong and require significant load to deflect, such as the force of the assembled flush tank.

In use, the bracket 12 is first mounted to the unassembled flush tank 14 by fitting the flush valve extension 28 through the central opening 36 of the bracket 12 and fitting the alignment tabs 40 into the recesses 30 formed in the back wall 32 of the flush tank 14. Then, a large nut 52 is threaded onto the flush valve extension 28 from the underside of the bracket 12 over which is fit a foam gasket ring 53. The squared shaft sections of the bolts 48 are then slid into the slots 42 with their heads between the bracket and the upper spring arms 46 (under the bottom wall of the flush tank). The flush tank 14 and bracket 12 assembly is then mounted to the bowl extension 16 by fitting the flush valve extension 28 and nut 52 into the opening 20 in the bowl extension 16 and by inserting the pre-aligned bolts 48 into two mounting holes 54 on each side of the main opening 20. Nuts 56 (shown in phantom) thread onto the bolts 48 from the bottom to tighten the flush tank 14 to the bowl base 18.

If the mating surfaces of the flush tank 14 and bowl extension 16 are properly spaced and sized, the spring arms 46 and 50 will deflect and generally uniformly flatten under the weight of the flush tank 14 so its bottom wall 22 rests on the top surface of the bracket 12 and the bottom surfaces of the stand-offs 44 and peripheral lips 38 will rest on the upper surface of the bowl extension 16. If the event that there is warping or casting variations that make the mating surfaces uneven, one or more of the spring arms 46 and 50 may not be uniformly deflected because of non-uniform loading at all spring locations due to the unevenness. Thus, at that point rather than flattening or bottoming out fully, the relevant spring arm will remain extending sufficiently to contact and support the mating surface of the flush tank or bowl extension, and thereby prevent teetering.

It should be appreciated that a preferred embodiment of the invention has been described above. However, many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced.

INDUSTRIAL APPLICABILITY

The invention provides improved assemblies for connecting a toilet tank to a bowl.

What is claimed is:

1. A toilet assembly, comprising:

a bowl with a rearward bowl extension having a flush opening leading to the bowl and at least one mounting hole;

a flush tank having a bottom wall and a tubular flush extension extending beyond the bottom wall into the flush opening of the bowl extension;

a bracket connecting the bowl to the tank and having:

(i) a generally planar body having a top face, a bottom face, and a central through opening extending between the top and bottom faces;

(ii) the body being formed with at least one mounting opening extending between the top and bottom faces; and (iii) the body also being formed with at least one unitary spring arm extending from a face of the body, the spring arm being deflectable outward and towards the face from which it extends; and a fastener extendable from an upper face of the body through the mounting opening.

2. The assembly of claim 1, wherein the mounting opening is a slot that is open laterally along a side of the body.

3. The assembly of claim 1, wherein the bracket has at least one upper spring arm extendable up above an upper face of the body and at least one lower spring arm extendable down below the bottom face of the body, both of these two spring arms being integrally formed with the body.

4. The assembly of claim 1, wherein the bracket has at least two upper spring arms extendable up above an upper face of the body and at least two lower spring arms extendable down below the bottom face of the body, all of the four spring arms being integrally formed with the body.

5. The assembly of claim 1, wherein the spring arm is in the form of an essentially horizontal portion linked to the body that is connected to a generally U-shaped portion that extends outward from and towards a face of the body.

6. The assembly of claim 1, wherein the spring arm has a free end.

7. The assembly of claim 1, wherein the body further comprises at least a pair of alignment tabs extending upward from the top face along a rear edge of the body.

* * * * *